US009449539B2

(12) United States Patent
Sciackitano et al.

(10) Patent No.: US 9,449,539 B2
(45) Date of Patent: Sep. 20, 2016

(54) SIMULATED NEON SIGN

(71) Applicant: FIREBOLT GROUP INC., Wixom, MI (US)

(72) Inventors: Brian Sciackitano, Chelsea, MI (US); Joel Sharp, Dexter, MI (US)

(73) Assignee: FIREBOLT GROUP INC., Wixom, MI (US)

( * ) Notice: Subject to any disclaimer, the term of this patent is extended or adjusted under 35 U.S.C. 154(b) by 0 days.

(21) Appl. No.: 14/767,937

(22) PCT Filed: Mar. 14, 2014

(86) PCT No.: PCT/US2014/027529

§ 371 (c)(1),
(2) Date: Aug. 14, 2015

(87) PCT Pub. No.: WO2014/152611

PCT Pub. Date: Sep. 25, 2014

(65) Prior Publication Data

US 2015/0371570 A1 Dec. 24, 2015

Related U.S. Application Data

(60) Provisional application No. 61/786,189, filed on Mar. 14, 2013.

(51) Int. Cl.

| | |
|---|---|
| ***G09F 13/22*** | (2006.01) |
| ***G09F 13/18*** | (2006.01) |
| ***G09F 13/16*** | (2006.01) |

(52) U.S. Cl.

CPC ..... *G09F 13/22* (2013.01); *G09F 13/16* (2013.01); *G09F 13/18* (2013.01); *G09F 2013/1895* (2013.01); *G09F 2013/222* (2013.01)

(58) Field of Classification Search

CPC ..... G09F 2013/185

See application file for complete search history.

(56) References Cited

U.S. PATENT DOCUMENTS

| | | | | |
|---|---|---|---|---|
| 2,886,911 A | | 5/1959 | Hardesty | |
| 3,968,584 A | * | 7/1976 | Kingston | G02B 6/0021 362/812 |
| 5,027,258 A | * | 6/1991 | Schoniger | G02B 6/0023 362/629 |
| 5,390,436 A | * | 2/1995 | Ashall | G02B 6/0043 362/618 |
| 2004/0255497 A1 | | 12/2004 | Venkataraman | |

* cited by examiner

*Primary Examiner* — Joanne Silbermann

(74) *Attorney, Agent, or Firm* — Quinn Law Group, PLLC

(57) ABSTRACT

A lighted sign has a front side and a back side, and includes a planar substrate and a light source. The light source is substantially coplanar with the substrate. A distressed area reflector is formed on the substrate and redirects light from the light source out of the planar substrate. The lighted sign also includes a cover layer disposed adjacent the planar substrate toward the front side and a linear graphic that is printed on the cover layer.

20 Claims, 3 Drawing Sheets

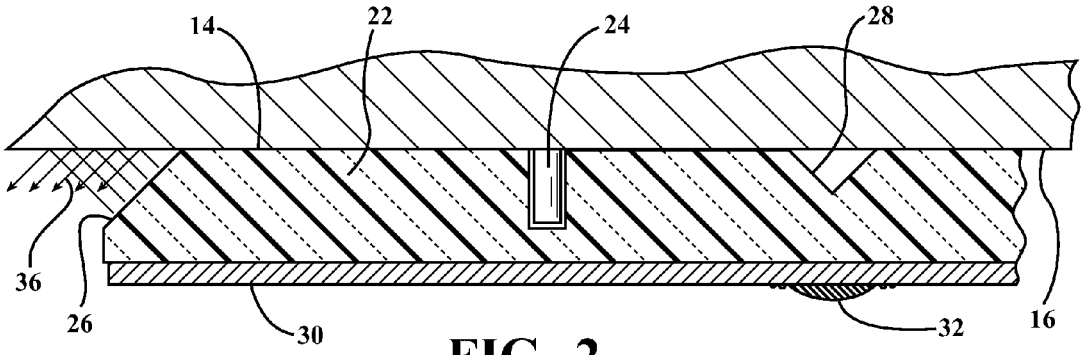
FIG. 2
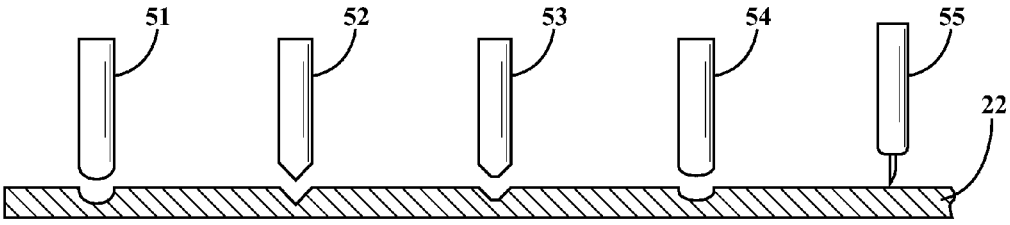
FIG. 4A
FIG. 4B
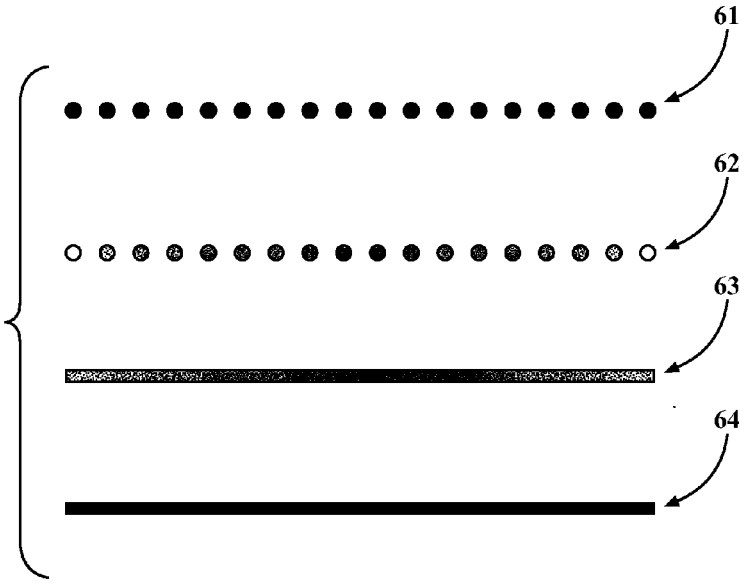

SIMULATED NEON SIGN

CROSS-REFERENCE TO RELATED APPLICATIONS

This application is a national phase of, and claims priority to, International Application No. PCT/US14/27529, filed 14 Mar. 2014, which claims the benefit of U.S. Provisional Application No. 61/786,189, filed 14 Mar. 2013, both of which are hereby incorporated by reference in their entirety.

TECHNICAL FIELD

This disclosure relates to lighted signs or displays.

BACKGROUND

Lighted signs or displays may be used to convey information or to advertise products and locations. Businesses, such a restaurants or retail stores, may use lighted signs to attract attention or display special notifications.

SUMMARY

A lighted sign for displaying a graphical message is provided. The lighted sign defines a front side and a back side. The lighted sign includes a planar substrate and a light source, which substantially intersects a plane with the substrate. A distressed area reflector is formed on the substrate and may redirect light from the light source out of the planar substrate. The lighted sign also includes a cover layer disposed adjacent the planar substrate toward the front side. A linear graphic is printed on the cover layer.

The above features and advantages, and other features and advantages, of the present invention are readily apparent from the following detailed description of some of the best modes and other embodiments for carrying out the invention, which is defined solely by the appended claims, when taken in connection with the accompanying drawings.

BRIEF DESCRIPTION OF THE DRAWINGS

FIG. 2 is a schematic cross-sectional view taken generally along line 2-2 of FIG. 1A;

FIG. 4A is a schematic illustration of various router profiles and plunge-depths for creating a distressed area reflector; and FIG. 4B is a schematic illustration of various laser etching patterns for creating a distressed area reflector.

DETAILED DESCRIPTION

Figure 1A:
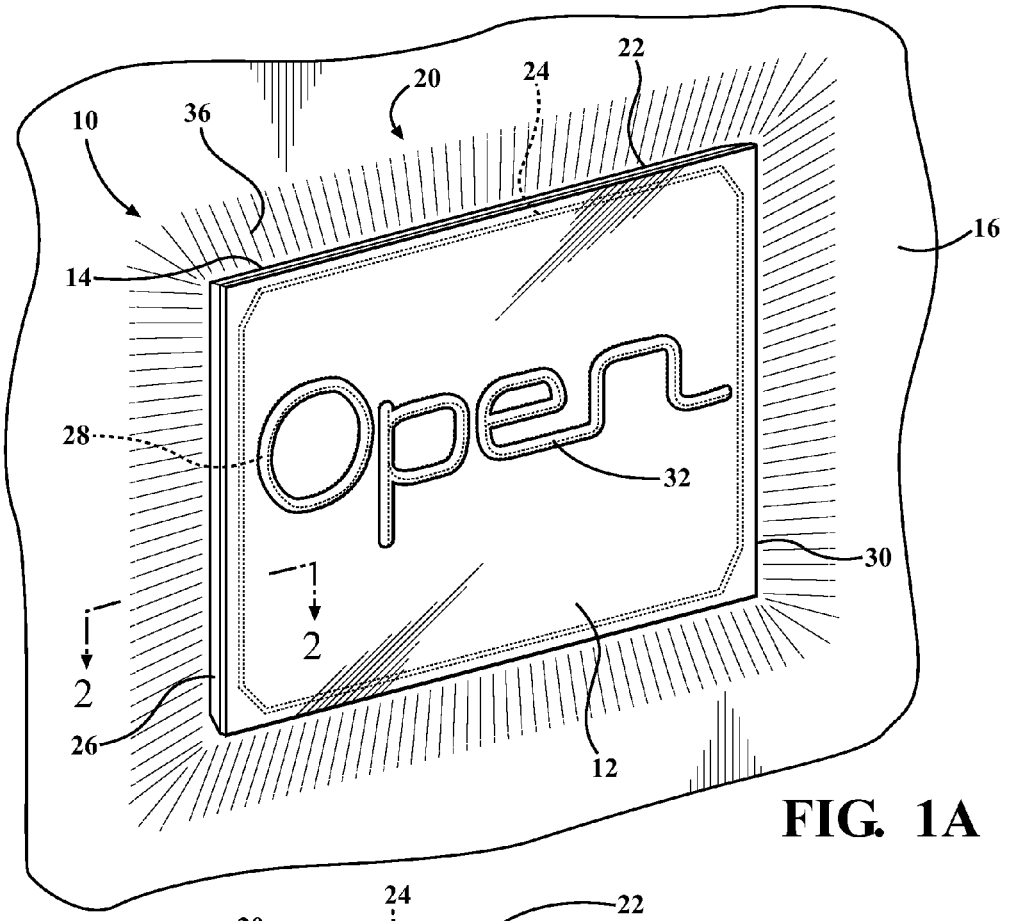
FIG. 1A is a schematic isometric view of a lighted sign displaying a graphical message.
Figure 1B:
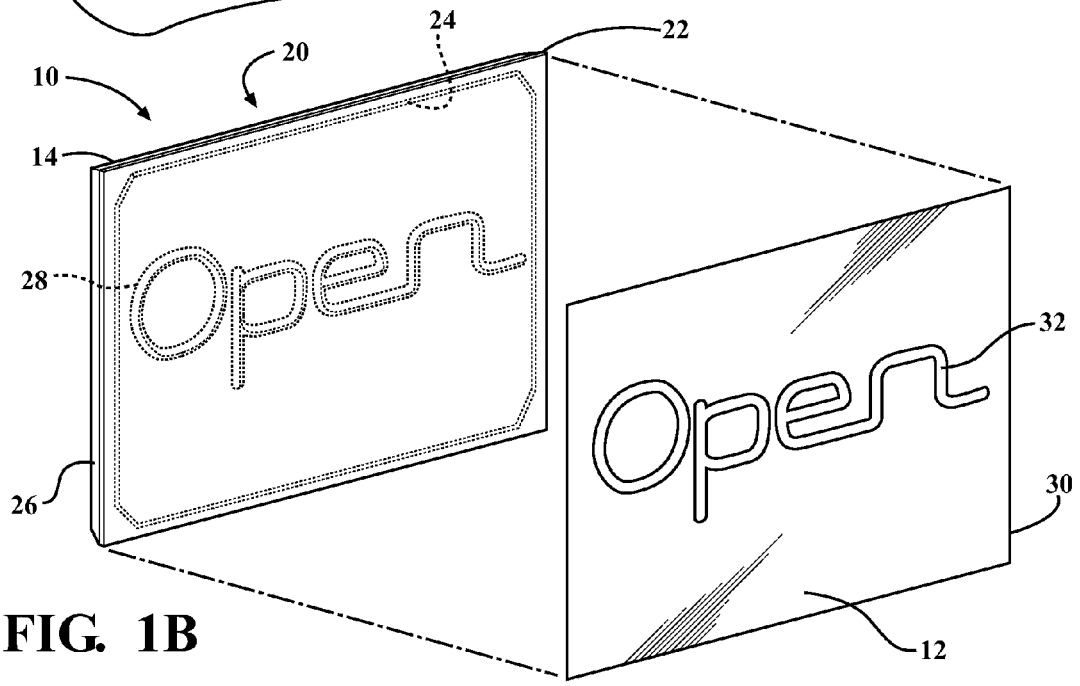
FIG. 1B is a schematic exploded view of the lighted sign shown in FIG. 1A.

Referring to the drawings, like reference numbers correspond to like or similar components wherever possible throughout the several figures. There are shown in FIG. 1A and FIG. 1B two views of a lighted sign 10. FIG. 1A shows an isometric view of the lighted sign 10, and FIG. 1B shows an exploded view. Note that the lighted sign 10 shown in FIGS. 1A and 1B may be stripped down, such that some configurations will include additional components or elements.

The lighted sign 10 has a front side 12 and a back side 14. The lighted sign 10 displays a graphical message, such as text or a logo. In the highly illustrative example shown in FIGS. 1A and 1B, the graphical message spells "Open." Generally, the graphical message is displayed toward a viewing area, which at least faces the front side 12 but may also include the back side 14.

The lighted sign 10 may be rear-mounted onto a mounting surface 16, which may be a wall, ceiling, or other solid structure. Alternatively, and without limitation, the lighted sign 10 may be front-mounted, such as onto a window, or suspended from above.

The graphical message of the lighted sign 10 mimics or simulates neon signs or neon lights formed from neon tubes. Neon lights are brightly glowing, electrified glass tubes or bulbs that contain neon or other gases across which high voltages are applied. The color displayed by the neon tube depends on the gas disposed within the tube. In addition to neon, gasses used within neon tube lights include: helium, carbon dioxide, argon, and mercury.

The lighted sign 10 emulates or simulates neon technology, but without the use of traditional neon signage material, particularly the gases normally disposed within the neon tubes. Furthermore, the lighted sign 10 requires significantly less energy for operation (whether continuous or intermittent) than traditional neon signs. The lighted sign 10 includes neither the glass tubes used in traditional neon nor any non-glass tubes.

While the present invention may be described with respect to specific applications or industries, those skilled in the art will recognize the broader applicability of the invention. Those having ordinary skill in the art will recognize that terms such as "above," "below," "upward," "downward," et cetera, are used descriptively of the figures, and do not represent limitations on the scope of the invention, as defined by the appended claims. Any numerical designations, such as "first" or "second" are illustrative only and are not intended to limit the scope of the invention in any way.

Features shown in one figure may be combined with, substituted for, or modified by, features shown in any of the figures. Unless stated otherwise, no features, elements, or limitations are mutually exclusive of any other features, elements, or limitations. Furthermore, no features, elements, or limitations are absolutely required for operation. Any specific configurations shown in the figures are illustrative only and the specific configurations shown are not limiting of the claims or the description.

The lighted sign 10 includes a backlight 20, which may also be considered to have front and back sides corresponding to the front side 12 and the back side 14 of the lighted sign 10. The backlight includes two primary components or elements: a substantially planar substrate 22 and a light source 24, which may be a plurality of light-emitting diodes (LED or LEDs), a continuous LED bar or strip, a plurality of incandescent lights, or another suitable light producing elements.

Due to manufacturing variability, the planar substrate 22 may be slightly warped or non-planar, but is configured to be ideally planar. The planar substrate 22 is formed from transparent light-conducting materials, including, without limitation: glass, acrylic, polycarbonate, polyethylene terephthalate (such as PET, PETE, of PETG), or blends thereof. Optical clarity and light conductivity are desirable factors when selecting material for the planar substrate 22, but other factors—such as cost, strength, and rigidity—may influence material selection.

The light source 24 substantially intersects the plane of, or is coplanar with, the planar substrate 22, such that light from the light source 24 is cast into the plane of the planar substrate 22. The light source 24 utilizes a plurality of lights or a continuous light-bar powered by an onboard or external PWM module or controller (not shown). Furthermore, the controller may allow animation by selectively lighting different portions of the lighting elements, such as individual LED elements, groups, or clusters of LED elements, in the light source 24 at different times. The light source 24 and the controller may be powered by 12-volt power or other suitable power for the light elements and for any other functions, such as controlling animation.

The light source 24 may be a flexible or rigid band having a plurality of individual light elements that is embedded within, or fixed to, to the planar substrate 22. Alternatively, a plurality of individual light elements may each be separately used to form the light source 24. Flexible light sources 24 may include, for example and without limitation, LED elements incorporated into flexible printed circuit (FPC) materials. Substantially rigid light sources 24 may include, for example and without limitation, LED elements incorporated into printed circuit board assemblies (PCBA).

Light from the light source 24 will obey the total internal reflection principle until it strikes a surface or region that can draw or expel the light from within the planar substrate 20. In the configuration shown in FIGS. 1A and 1B, the light source 24 is embedded within the planar substrate 22.

However, the light source 24 may also be adjacent to an open edge 26 of the planar substrate 22, such that the light source 24 is disposed along all or a portion of the outside perimeter of the planar substrate 22 and the lighted sign 10. When the light source 24 is disposed at the perimeter of the planar substrate 22, the open edge 26 may be substantially perpendicular to the planar substrate 22. Unless the light source 24 is focused, masked, or funneled into a smaller band, the size of the light source 24 will likely be equal to, or less than, the thickness of the planar substrate 22.

Where LED elements are used for the light source 24, as illustrated in the figures, different LED elements may be used in the light source 24 to achieve different goals. For example, more-powerful LED elements may be used to accommodate larger surface areas of the planar substrate 22 and the graphical message, or colored LED elements may be used for a colored edge glow or halo.

As used herein, the term substantially refers to quantities, values, dimensions, or alignments that are within manufacturing variance or tolerance ranges of being exact. Substantially equal dimensions, for example, may be planned as ideally equal but normal manufacturing tolerances may cause the resulting dimensions to vary by 10-20% for different pieces. Substantially aligned, for example, refers components that are intended to be truly aligned but may be slightly offset when assembled under real world manufacturing conditions.

The backlight 20, which is a combination of the planar substrate 22 and the light source 24, provides structural functions for the lighted sign. The planar substrate 22 is sufficiently rigid to provide the necessary structural support for the remainder of the lighted sign 10, such that fasteners or hanging hardware may be directly attached to the planar substrate 22.

Referring also to FIG. 2, and with continued reference to FIGS. 1A and 1B, there is shown a cross-sectional view of the lighted sign 10 taken along line 2-2 of FIG. 1A. A distressed area reflector 28 (DAR) is formed on the backlight 20. More specifically, the distressed area reflector 28 is defined in the planar substrate 22.

The distressed area reflector 28 may be formed or defined on either the front side 12 or the back side 14 of the planar substrate 22, and is illustrated as defined into the back side 14 of the planar substrate 22 in FIG. 2. The distressed area reflector 28, which may include several regions or areas of distress on the planar substrate 22, may be created via various methods, including, without limitation: laser etching, routed grooves or reliefs, media blasting, or screen printing.

The distressed area reflector 28 is a selectively distressed area of the backlight 20 that takes light cast from the light source 24 into the planar substrate 22 and pulls or redirects that light out of the planar substrate 22 at specific locations in a controlled fashion. The light from light source 24 then illuminates the graphic message. The distressed area reflector 28 at least partially defines the graphical message, which may include, without limitation: letters, shapes, logos, or informational messages. However, as best viewed in FIG. 2, the distressed area reflector 28 may be formed on the back side 14 of the planar substrate 22, opposite from the graphical message.

A cover layer 30 is disposed on the front side 12 of the planar substrate 22. The cover layer 30 houses or carries at least one portion, or one layer, of the graphical message of the lighted sign 10. A linear graphic 32 is printed on the cover layer 30. The linear graphic 32 conveys the graphical message while simulating the visual appearance of neon tubes. The linear graphic 32 and the distressed area reflector 28 combine to display the word "Open" in the illustrative lighted sign 10 shown in the figures.

Note that components of the lighted sign 10 shown in the figures may not be illustrated to scale. Particularly, the planar substrate 22, the light source 24, the cover layer 30, and the linear graphic 32 may be over-sized—for illustrative purposes—in some or all of the figures relative to production versions of the lighted sign 10.

As best viewed in FIGS. 1B and 2, the linear graphic 32 directly overlays the distressed area reflector 28 in the lighted sign 10. Alternatively stated, the linear graphic 32 geometrically correlates with the distressed area reflector 28, such that the linear graphic 32 and the distressed area reflector 28 cooperate to produce color, texture, contrast, and dimension to provide the neon tube effect of the lighted sign 10.

For exemplary purposes only, if the distressed area reflector 28 is one-half inch wide, the linear graphic 32 may also be substantially one-half inch wide. Note that size or thickness of the linear graphic 32 in FIG. 2 is overstated to better illustrate the location of the printed material relative to the distressed area reflector 28.

The lighted sign 10 may include several features that are configured to better approximate or simulate the visual look of neon tube signs. For example, the cover layer 30 may be transparent at the linear graphic 32, but the remainder of the cover layer 30 may be translucent. Therefore, the portion of the cover layer 30 having the linear graphic 32 printed thereon may have different light passage properties than the remainder. Note that translucent materials permit light to pass through but diffuse the light, while transparent materials allow passage of light largely unaltered.

In the lighted sign 10 shown, the light source 24 is embedded within the planar substrate 22, such as within a trough (not numbered). Note that the light source 24 does not plunge completely through the planar substrate 20, such that it leaves a gap 29 and some light is able to pass from one side of the light source 24 to the other through the planar substrate 22. In some configurations, the light source 24 will cast light in only one direction, such as toward the distressed area reflector 28, as viewable in FIG. 2. However, because the light source 24 is embedded within the planar substrate 22, light may pass through the gap 29 to the opposing side of the light source 24 from the distressed area reflector 28.

As schematically illustrated in FIG. 2, the linear graphic 32 includes a solid portion directly overlaying the distressed area reflector 28 and a gradation that fades the linear graphic 32 outward from the solid portion. In FIG. 2, this blurring or fading effect is illustrated through line thickness and solidity on the cover layer 20. However, the printed linear graphic 32 may not be viewable on this same scale.

For example, if the distressed area reflector 28 is three-eighths inch wide, the solid portion of the linear graphic 32 may be substantially three-eighths inch wide. Then, the gradated fading outward of the linear graphic 32 may be one-quarter of an inch in each direction from the solid portion. The gradated fading may contribute to emulating neon tubes by simulating the glowing, rounded, or halo effects of tubular lights within a sign.

As schematically illustrated in FIG. 2, the lighted sign 10 includes the open edge 26 along the exterior of the planar substrate 22. The open edge 26 may be perpendicular to the general plane of the planar substrate 22—particularly in configurations having the light source 24 be disposed along the open edge 26—or the open edge 26 or may be profiled or a beveled, as shown.

In the configuration shown, the light source 24 is disposed between the open edge 26 and the linear graphic 32, as opposed to surrounding or framing the perimeter adjacent the open edge 26. Therefore, the open edge 26 casts a halo 36 or outer glow effect outward—i.e., away from the distressed area reflector 28, relative to the light source 24—from the planar substrate 22 and onto any surrounding mounting surface 16. The halo 36 may emulate the glow cast by tubular neon lights adjacent to surfaces or may improve the aesthetics of the lighted sign 10.

Figure 3:
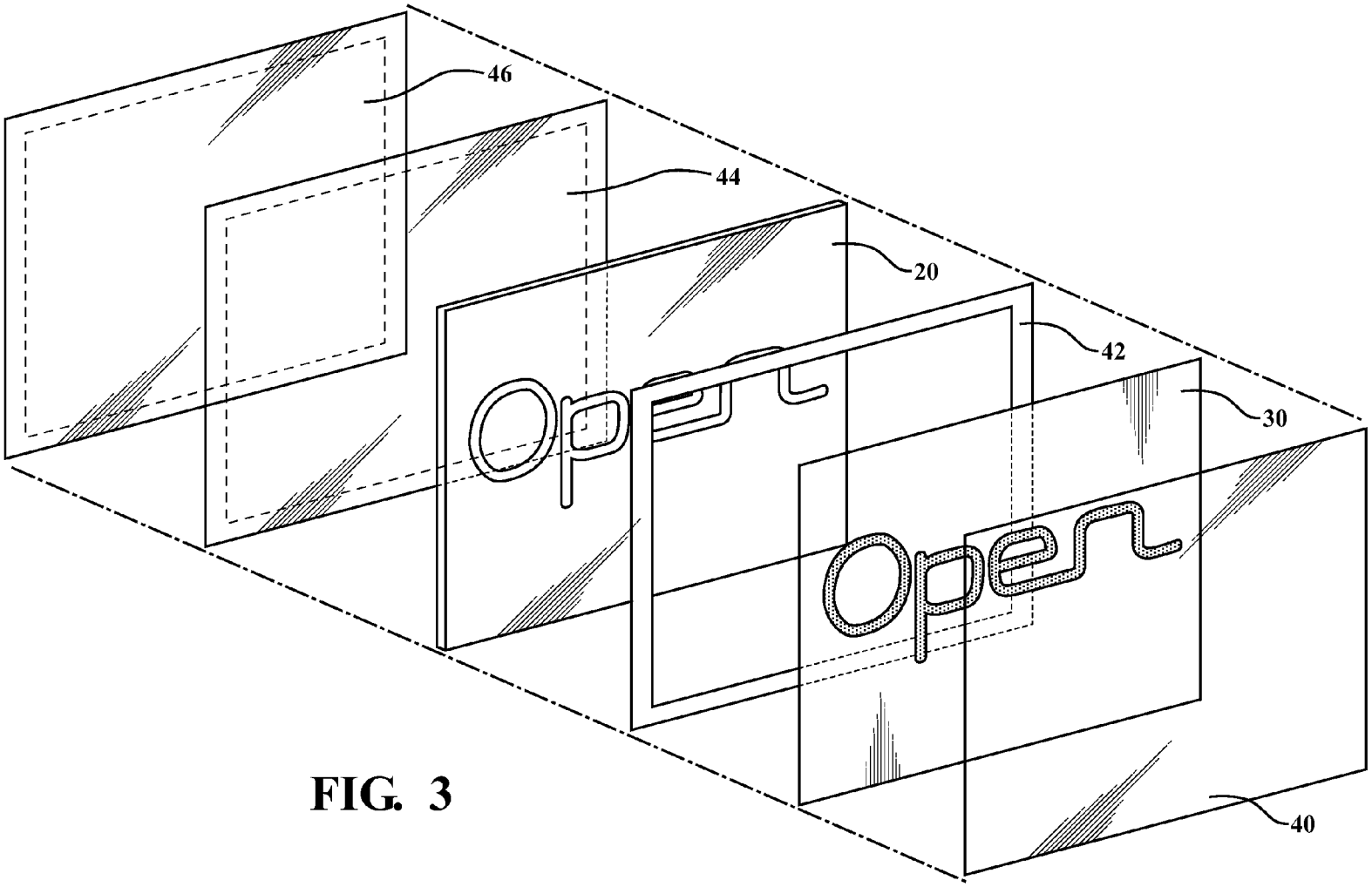
FIG. 3 is a schematic exploded isometric view of additional layers or components for the lighted sign shown in FIG. 1A and FIG. 1B.

Referring now to FIG. 3, and with continued reference to FIGS. 1A, 1B, and 2, there is shown an exploded view of an alternative configuration of the lighted sign 10. In the configuration of FIG. 3, the lighted sign 10 includes additional layers or components beyond the backlight 20 (including the planar substrate 22 and the distressed area reflector 28) and the cover layer 30 (including the linear graphic 32).

As shown in FIG. 3, the lighted sign 10 may further include a shield layer 40, which protects the front side 12 from scratches, debris, ultraviolet light, or other environmental factors that may negatively affect the lighted sign 10. Alternatively, these protective function may be performed by the cover layer 30, or coatings applied to the cover layer 30, depending upon the materials used therefore. For example, the cover layer 30 may have the linear graphic 32 printed on a interior side adjacent the backlight 20, such that an unprinted side of the cover layer 30 faces the front side 12 of the lighted sign 10 and protects the linear graphic 32 from damage.

Other layers of the lighted sign 10 include an opaque mask 42 coving the light source 24. The opaque mask 42 may be used to obscure glare from the light source 24 and prevent light from exiting perpendicularly through the front side 12 of the planar substrate 22. Alternatively, the masking function may be performed by the cover layer 30, such as with an opaque region printed over the light source 24, or by a frame (not shown) used to outline and provide structure for the lighted sign 10.

Further components or layers may include a reflector 44 adjacent the back side 14 of the backlight 20. In spite of total internal reflection, some light may escape the planar substrate 22 toward the back side 14 of the lighted sign 10. However, the reflector 44 reflects or redirects some or all of the rearward light toward the front side 12.

A backing board 46 may be attached to the backlight 20 and the reflector 44, if included. The backing board 46 and the reflector 44 may provide additional structural support for the lighted sign 10, and may provide attachment points for fasteners or hanging hardware used to mount the lighted sign 10 to a wall, ceiling, or other environmental structure.

In some configurations of the lighted sign 10, fasteners may be connected between the backing board 46 and the shield layer 40 to hold all of the layers and components of the lighted sign 10 together. Other configurations of the lighted sign 10, including those having fewer layers than that shown in FIG. 3, may be joined via adhesives, fasteners, edge-mounted frames or clips, or combinations thereof.

Referring now to FIG. 4A and FIG. 4B, there are shown highly schematic illustrations of tools, mechanisms, or techniques for creating a distressed area reflector (DAR), such as those shown and illustrated in FIGS. 1A-3. FIG. 4A schematically illustrates several different profiles, tool depths, and tool types for defining a DAR in a substrate, such as the planar substrate 22. FIG. 4B schematically illustrates various laser etching patterns for creating the DAR on the substrate.

As illustrated in FIG. 4A, milling or routing tools may be used to create, for example and without limitation: a concave profile 51, a V-groove profile 52, a W-groove profile 53 or a custom profile 54. Furthermore, a drag scoring profile, which has little or no depth when compared to the other profiles shown in FIG. 4A, may be created with a scoring tool 55.

As illustrated in FIG. 4B, the DAR may also be created through laser etching techniques. To control the amount of light drawn through the surface of the substrate, several patterns of laser etching may be used. The laser etching patterns may include, for example and without limitation: a uniform dot pattern 61, a gradated dot pattern 62, a gradated score 63, and a uniform score 64.

The configurations shown and described above apply to substantially-planar lighted signs 10, having the planar substrate 22. However, in some embodiments, the substrate may be slightly curved. Any curvature is limited to allow total internal reflection, such that light from the light source remains within the substrate until it contacts the DAR or an edge or bevel of the substrate. Furthermore, the planar substrate 22 may have variable thickness while remaining substantially planar.

The detailed description and the drawings or figures are supportive and descriptive of the invention, but the scope of the invention is defined solely by the claims. While some of the best modes and other embodiments for carrying out the claimed invention have been described in detail, various alternative designs, configurations, and embodiments exist for practicing the invention defined in the appended claims.

The invention claimed is:

1. A lighted sign having a front side and a back side, comprising:

a planar substrate;

a light source substantially intersecting a plane of the substrate, wherein the light source is an LED light source formed from a plurality of light-emitting diode (LED) elements;

a distressed area reflector formed at specific locations on only a portion of the planar substrate;

a cover layer disposed adjacent the planar substrate toward the front side, wherein the cover layer is substantially planar and substantially continuous; and a linear graphic printed on the cover layer, wherein the linear graphic geometrically correlates to the distressed area reflector.

2. The lighted sign of claim 1, wherein the portion of the cover layer on which the linear graphic is printed is transparent and the remainder of the cover layer is translucent.

3. The lighted sign of claim 2, wherein the LED light source is embedded within the planar substrate.

4. The lighted sign of claim 3, wherein the linear graphic includes a solid portion directly overlaying the distressed area reflector and a gradated portion fading outward from the solid portion.

5. The lighted sign of claim 4, further comprising:

an open edge defined on at least one perimeter edge of the planar substrate, such that the open edge casts a halo from the planar substrate.

6. The lighted sign of claim 5, further comprising:

an opaque mask coving the LED light source.

7. The lighted sign of claim 6, wherein the open edge of the planar substrate is beveled.

8. The lighted sign of claim 1, wherein the distressed area reflector is formed on the planar substrate facing the back side of the lighted sign.

9. The lighted sign of claim 1, wherein the light source is embedded within the planar substrate.

10. The lighted sign of claim 9, further comprising:

an opaque mask covering the light source.

11. The lighted sign of claim 10, further comprising:

an open edge defined on at least one perimeter edge of the planar substrate, such that the open edge casts a halo from the planar substrate.

12. The lighted sign of claim 1, wherein the distressed area reflector is a groove formed in the planar substrate.

13. A lighted sign having a front side and a back side, comprising:

a planar substrate;

a light source substantially intersecting a plane of the substrate;

a distressed area reflector formed at specific locations on only a portion of the planar substrate;

a cover layer disposed adjacent the planar substrate toward the front side, wherein the cover layer is substantially planar and substantially continuous; and a linear graphic printed on the cover layer, wherein the linear graphic includes a solid portion directly overlaying the distressed area reflector and a gradated portion fading outward from the solid portion.

14. The lighted sign of claim 13, wherein the linear graphic geometrically correlates to the distressed area reflector.

15. The lighted sign of claim 14, wherein the portion of the cover layer on which the linear graphic is printed is transparent and the remainder of the cover layer is translucent.

16. A lighted sign, comprising:

a planar substrate having a front side and a back side;

a light source substantially coplanar with the planar substrate;

a distressed area reflector formed at specific locations on only a portion of the planar substrate, wherein the distressed area reflector redirects light from the light source out of the planar substrate;

a cover layer disposed adjacent the front side of the planar substrate, wherein the cover layer is substantially planar, substantially continuous, and covers substantially the entire planar substrate; and a linear graphic printed on the cover layer, wherein the linear graphic geometrically correlates to the distressed area reflector.

17. The lighted sign of claim 16, wherein the light source is an LED light source formed from a plurality of light-emitting diode (LED) elements.

18. The lighted sign of claim 17, wherein the LED light source is embedded within the planar substrate.

19. The lighted sign of claim 18, wherein the distressed area reflector is formed on the back side of the planar substrate.

20. The lighted sign of claim 16, wherein the distressed area reflector is a groove formed in the planar substrate.

* * * * *